US011285514B2

(12) United States Patent
Heitfeld et al.

(10) Patent No.: US 11,285,514 B2
(45) Date of Patent: Mar. 29, 2022

(54) APPARATUS, SYSTEM AND METHOD FOR FASTENING A SCREEN ON A GYRATORY SIFTER

(71) Applicant: M-I LLC, Houston, TX (US)

(72) Inventors: Mark A. Heitfeld, Cleves, OH (US); Christopher T. Meranda, Union, KY (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/145,747

(22) Filed: May 3, 2016

(65) Prior Publication Data

US 2021/0268546 A1 Sep. 2, 2021

(51) Int. Cl.
*B07B 1/49* (2006.01)
*B07B 1/48* (2006.01)

(52) U.S. Cl.
CPC ..... *B07B 1/48* (2013.01); *B07B 1/485* (2013.01); *B07B 1/49* (2013.01)

(58) Field of Classification Search
CPC ..... B07B 1/48; B07B 1/485; B07B 1/49
USPC ..... 209/326
See application file for complete search history.

(56) References Cited

U.S. PATENT DOCUMENTS 3,666,095 A * 5/1972 Krynock ..... B07B 1/46 209/254
4,028,232 A * 6/1977 Wallis ..... B01D 35/20 210/785
5,485,924 A 1/1996 Zaun
6,155,428 A 12/2000 Bailey et al.
6,820,747 B2 11/2004 Watters et al.
7,175,027 B2 2/2007 Strong et al.
7,216,768 B2 5/2007 Fisher et al.
7,478,728 B2 * 1/2009 Fisher ..... B07B 1/485 209/319
7,850,011 B2 12/2010 Fisher et al.

FOREIGN PATENT DOCUMENTS

CN 2172683 Y 7/1994
CN 2381404 Y 6/2000
CN 101018618 A 8/2007
EP 1224984 A2 7/2002
WO 2004/069374 A1 8/2004
(Continued)

OTHER PUBLICATIONS

Examiner's Report issued in Canadian Patent Application 3022301 dated Sep. 1, 2020, 4 pages.
(Continued)

*Primary Examiner* — Mark Beauchaine
(74) *Attorney, Agent, or Firm* — Jeffrey D. Frantz

(57) ABSTRACT

An apparatus, system and method for fastening a screen has a screen with apertures sized to separate a first sized material from a second sized material. A box is positioned beneath the screen in a bracket extending along the screen. A protrusion extends from the box toward the screen. A triangular tensioning element secured along a length of the screen moves in a direction substantially perpendicular to the length of the screen in response to contact with the protrusion to seal the screen against the bracket and tension the screen.

19 Claims, 3 Drawing Sheets

(56) References Cited

FOREIGN PATENT DOCUMENTS

| | | | | |
|---|---|---|---|---|
| WO | WO-2004069374 A1 * | 8/2004 | ..... | B07B 1/485 |
| WO | 2007067300 A2 | 6/2007 | | |

OTHER PUBLICATIONS

International Search Report and Written Opinion for the equivalent International patent application PCT/US2017/029496 dated Aug. 8, 2017.
International Preliminary Report on Patentability for the equivalent International patent application PCT/US2017/029496 dated Nov. 15, 2018.
Office Action for the equivalent German patent application 112017002325.4 dated Mar. 21, 2019 including machine translation into English.
Examination Report for the equivalent Canadian patent application 3022301 dated Oct. 9, 2019.
First Chinese Office Action issued in Chinese Patent Application No. 2017800276140 dated Feb. 3, 2021, 16 pages.

* cited by examiner

APPARATUS, SYSTEM AND METHOD FOR FASTENING A SCREEN ON A GYRATORY SIFTER

BACKGROUND OF THE INVENTION

Separators are used to separate solids from liquids in oil-based and/or water-based drilling fluids, referred to as mud, that are retrieved from oilfield drilling operations. Such separators may have sifting and/or filtering screens to remove solids from a slurry. One type of apparatus used to separate solids from the mud is referred to in the industry as a shale shaker and/or as a gyratory sifter. The gyratory sifter, also known to as a vibratory separator, uses a sieve to accept used drilling mud to clean the mud for further use in drilling operations.

Mud serves multiple purposes in the oilfield services industry. For instance, mud acts as a lubricant to cool rotary drill bits and facilitate faster cutting rates. Further, dispersion of the mud around a drill bit string or otherwise in the wellbore assists in counterbalancing various pressures in subterranean formations. Various weighting and lubrication agents are mixed into the mud to obtain a desirable mixture for the type and construction of the rock formation to be drilled. Since the cost of mud can expensive, drillers and service companies typically reclaim and reuse mud in drilling operations. Another purpose of the drilling mud is to carry rocks and/or cuttings from the drill bit to the surface.

Typically, gyratory sifters use sifting and/or filtration screens to separate cuttings from drilling fluid in on-shore and off-shore oilfield drilling operations. Screens in gyratory sifters comprise a mesh and/or a lattice stretched across a frame. The mesh allows fluid and/or particles smaller than a predetermined size to pass through the separating screen.

Vibrational movement during operation of the gyratory sifter may contribute to and/or cause the detachment of the screen mounted within the gyratory sifter, thus limiting the ability of the screen to effectively filter and/or separate materials. To address such unwanted movement and/or detachment of the screen from the gyratory sifter, a screen fastening system and/or tensioning system may fasten a screen to a gyratory sifter to filter solids from liquid in a slurry flowing over and/or through the screen. Devices described herein may be utilized to create a screen tensioning and/or sealing mechanism that may uniformly tension the screen along an edge of the screen flush with the bracket. Further the devices may create a sealing surface to prevent bypass of oversized particles through the screen and/or screen tensioning mechanism.

DETAILED DESCRIPTION

Embodiments disclosed herein are applicable to separation devices that may be utilized in numerous industries.

While specific embodiments may be described as utilized in the oilfield services and related industries, such as use with shale shakers, the device may be applicable in other industries where separation of liquid-solid, solid-solid and other mixtures may be separated. The embodiments may be utilized in the mining, pharmaceutical, food, medical or other industries to separate such mixtures.

In the following detailed description, reference is made to accompanying figures, which form a part hereof. In the figures, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented here. It will be understood that the aspects of the present disclosure, as generally described herein, and illustrated in the figures, may be arranged, substituted, combined and designed in a wide variety of different configurations, which are explicitly contemplated and form part of this disclosure.

Figure 1:
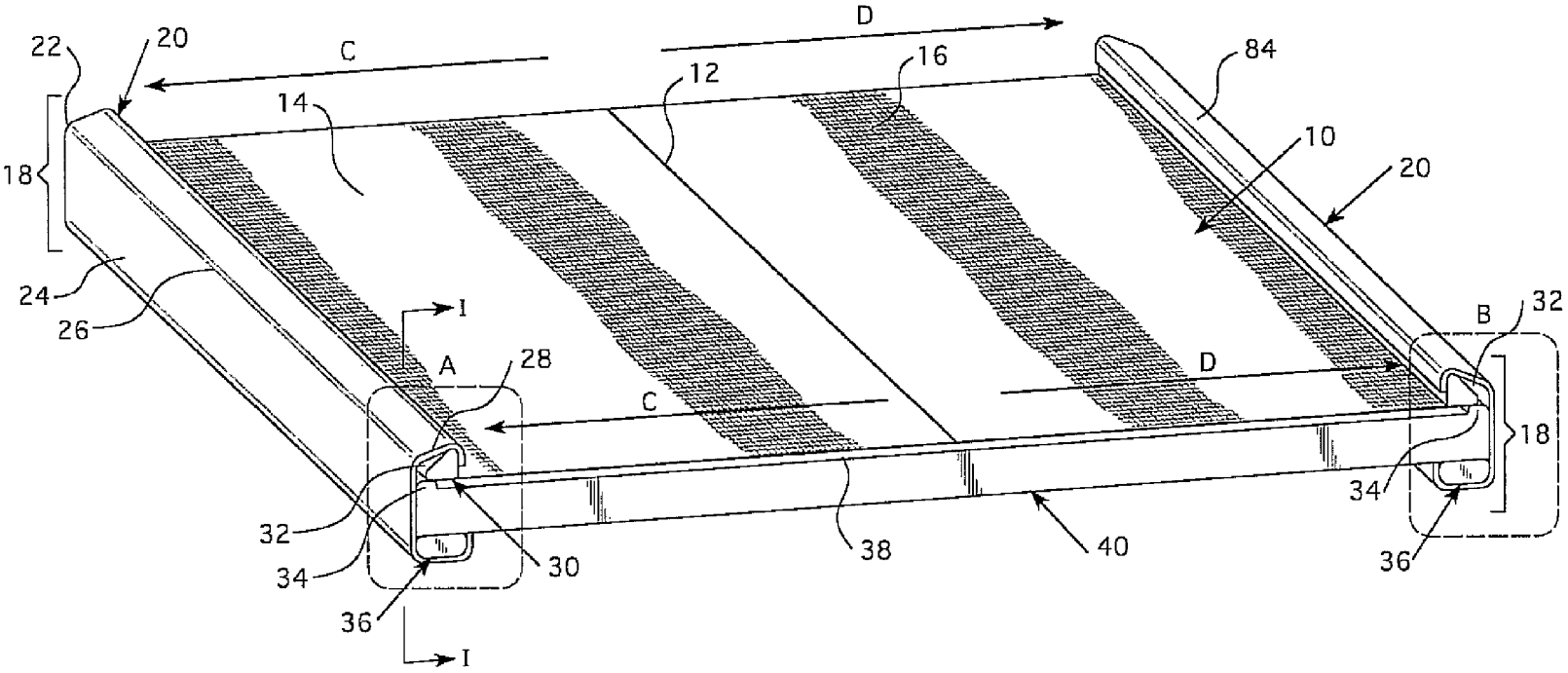
FIG. 1 illustrates a perspective view of a screen fastening system in accordance with an embodiment of the invention.

Referring to FIG. 1, a filtration screen 10 having a left side section 14 and a right side section 16 divided by a partition 12 is shown. In an embodiment, the filtration screen 10 may be made from a woven screen cloth and/or may have apertures sized to separate incoming material by size. For example, a solid-solid mixture with solid particles of various sizes may be sifted and/or separated according to the size of each particle to, for example, separate a particle of a first size from a particle of a second size. The left side section 14 of the filtration screen 10 may be stretched and/or pulled in a direction C toward a bracket 18. In an embodiment, the bracket 18 may be referred to as a rail or a screen rail. Likewise, the right side section 16 of the filtration screen 10 may be stretched and/or pulled in a direction D toward the bracket 18 which may be mounted in an orientation opposite to the direction C. Accordingly, the left side section 14 may be stretched in the direction C, and the right side section 16 may be stretched in the direction D to secure the filtration screen 10 to the brackets 18.

Figure 2:
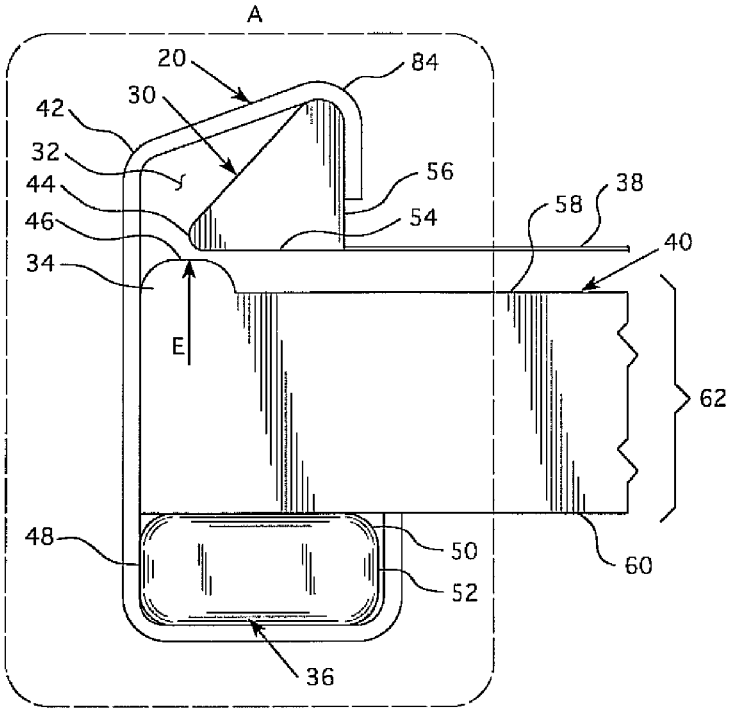
FIG. 2 illustrates a cross-sectional view taken generally along line I-I of FIG. 1 in accordance with an embodiment of the invention.

In an embodiment, a box 40 may vibrate the filtration screen 10 to assist in the filtration and/or separation of solids from liquid in a slurry flowing through the filtration screen 10. A gap 38 may separate the filtration screen 10 from the box 40. A region A may be defined on the bracket 18, and a region B may be defined on the bracket 18. In an embodiment, the region B may be substantially symmetrical to the region A. As shown in the region A in FIG. 1, the bracket 18 may enclose a triangular tensioning element 30 that may abut and/or otherwise contact a curved retaining wall 84. The triangular tensioning element may attach to the filtration screen 10 along the bracket 18. In an embodiment, the curvature of the retaining wall 84 may match the shape of the triangular tensioning element 30 to allow for a flush and/or secure fitment of the triangular tensioning element 30 within the bracket 18, as shown in FIG. 2.

A sloping portion 20 of the bracket 18 may extend from the retaining wall 84 to create a cavity 32 within the sloping portion 20 that may receive the triangular tensioning element 30. Specifically, the triangular tensioning element 30 may rotate and/or move in the cavity 32 by pressing against a contact surface 46 of a protrusion 34 in a direction E with a corner 44 of the triangular tensioning element 30, as shown in FIG. 2. In an embodiment, the protrusion 34 may be referred to as an angled portion of the box 40.

Figure 3:
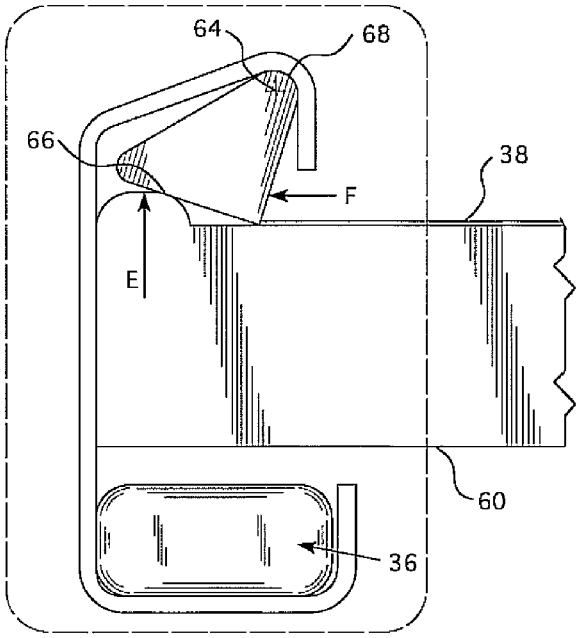
FIG. 3 illustrates a cross-sectional view taken generally along line I-I of FIG. 1 in accordance with an embodiment of the invention.

An air bag 36 may be positioned beneath the box 40. Upon activation, the air bag 36 may receive air and/or a gaseous fluid to rise in the direction E. In an embodiment, the air bag 36 may be referred to as a bladder. The air bag 36 may compress the contact surface 46 of the protrusion 34 against the triangular tensioning element 30. The compression may cause movement and/or rotation of the triangular tensioning element 30 toward the box 40, as shown in FIG. 3. The box 40 may, due to the rotation of the triangular tensioning element 30 toward the box, push against the filtration screen 10 to secure the filtration screen 10 in position.

In an embodiment, a ridge 26 may connect to the sloping portion 20 of the bracket 18 and may extend from the region A toward a distal end 22. Further, the ridge 26 may be integral with the sloping portion 20 and a retention wall 24 to form a bend 42 as shown in FIG. 2, for example. In an embodiment, the bend 42 may be referred to as an angled portion of the bracket 18. The retention wall 24 may extend from the ridge 26 and may hold and/or retain the air bag 36, the box 40, the protrusion 34, the triangular tensioning element 30 and/or the filtration screen 10. The region B may be substantially similar and/or symmetrical to the region A.

Referring to FIG. 2, the bracket 18 is shown housing the air bag 36, the box 40 with the protrusion 34 and the triangular tensioning element 30. In an embodiment, a mesh wire screen 38 that may be attached to the triangular tensioning element 30 at the region A and/or the region B may be placed on the box 40. Solids may be collected and/or separated from liquid passing through the mesh wire screen 38.

The box 40 may have an underside 60 and a depth 62 that separates the underside 60 from a top surface 58. The air bag 36 may be actuated and/or activated to receive air and/or gaseous fluid to expand an outer surface 50 of the air bag 36. The outer surface 50 of the air bag 36 may expand to spread a left wall 48 and a right wall 52 of the air bag 36 outward and to push the outer surface 50 toward the box 40. Movement in the direction E of the outer surface 50 of the box 40 may shift the contact surface 46 of the protrusion 34 upward to contact and/or compress the corner 44 of the triangular tensioning element 30.

Compression of the contact surface 46 against the corner 44 may rotate the triangular tensioning element 30 toward the mesh wire screen 38 to clamp against the mesh wire screen 38, as shown in FIG. 3, for example. Further, compression of the contact surface 46 against the corner 44 may pull and/or apply tension to the first section 14 of the filtration screen 10 and/or the mesh wire screen 38 in the direction C and/or in the direction D toward the brackets 18, respectively.

The triangular tensioning element 30 may have a lead side 56 attached and/or adhered to the filtration screen 10 and/or the mesh wire screen 38. Rotation of the triangular tensioning element 30 in a direction F as shown in FIG. 3 into the cavity 32 may fit and/or secure the triangular tensioning element 30 into the bend 42 and/or the retaining wall 84. In an embodiment, the triangular tensioning element 30 that may be secured in the bracket 18 may assist gyratory vibration and/or filtration by holding the filtration screen 10 and/or the mesh wire screen 38 by applying tension in the direction F.

Referring to FIG. 3, the box 40 is shown moved in the direction E to form a first seal 66. The contact surface 46 of the protrusion 34 may contact the corner 44 to rotate the triangular tensioning element 30 around an axis 64 toward the sloping portion 20. A second seal 68 may be formed where the triangular tensioning element 30 contacts the retaining wall 84, as shown in FIG. 2. The second seal 68 may assist the triangular tensioning element 30 to rotate around the axis 64 and to apply tension in the direction F. The filtration screen 10 and/or the mesh wire screen 38 may be held against the bracket 18 by tension in the direction F.

Figure 4:
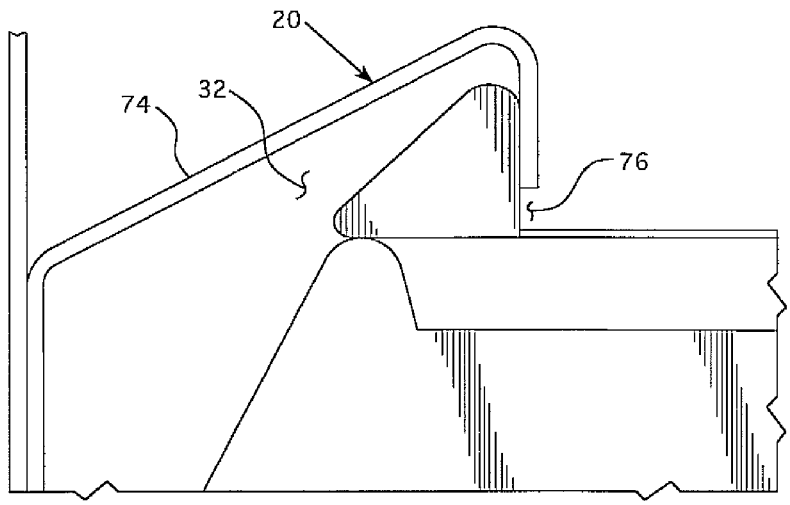
FIG. 4 illustrates a side view of a screen fastening system in accordance with an embodiment of the invention.

Referring to FIG. 4, the sloping portion 20 is shown in accordance with an embodiment of the invention. The sloping portion 20 may be substantially parallel to the retaining wall 26 as shown in FIG. 1 and/or may replace the retaining wall 26. An inclined section 74 may extend from the sloping portion 20 to define an insertion point 76. The filtration screen 10 and/or the mesh wire screen 38 may be threaded through the insertion point 76 to engage with the box 40 and/or the air bag 36 which may expand to secure the filtration screen 10.

Figure 5:
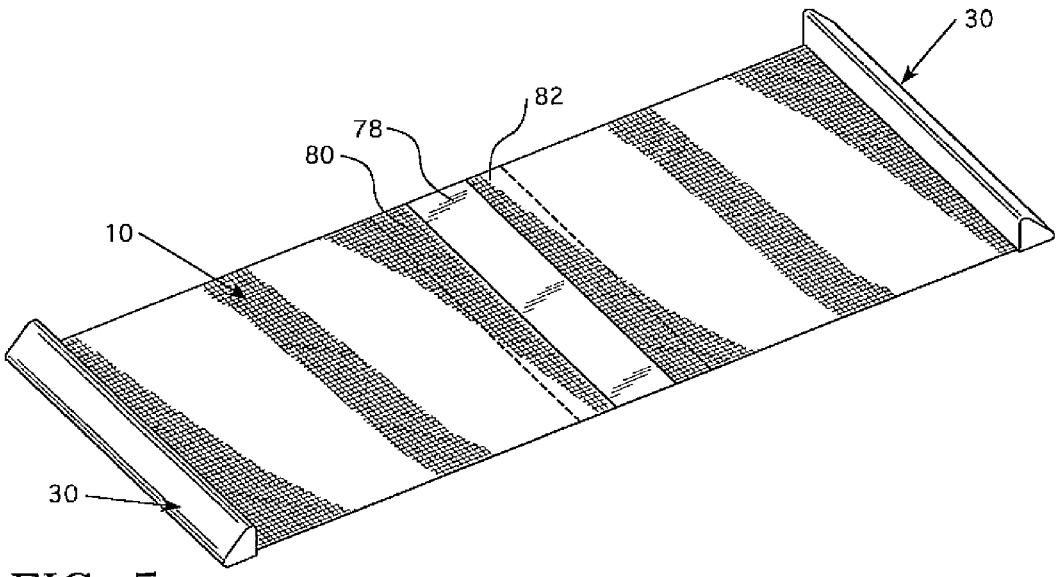
FIG. 5 illustrates a perspective view of a screen in accordance with an embodiment of the invention.

Referring to FIG. 5, a perspective view of the filtration screen 10 is shown that may be attached to the triangular tensioning elements 30. A centerpiece 78 may bisect the filtration screen 10 and may be formed of an adhesive material to join to the filtration screen at a left side junction 80 and/or a right side junction 82. The triangular tensioning element 30 may be slid into the bracket 18.

Although the preceding description has been described herein with reference to particular means, materials, and embodiments, it is not intended to be limited to the particulars disclosed herein; rather, it extends to all functionally equivalent structures, methods, and uses, such as are within the scope of the appended claims.

The invention claimed is:

1. An apparatus comprising:

a screen having apertures sized to separate a first sized material from a second sized material;

a box positioned beneath the screen in a bracket extending along the screen;

a protrusion extending from the box toward the screen;

a triangular tensioning element secured along a length of the screen wherein the triangular tensioning element moves in a direction substantially perpendicular to the length of the screen in response to contact with the protrusion to seal the screen against the bracket and tension the screen; and a ridge extending along the bracket wherein the ridge guides the triangular tensioning element.

2. The apparatus of claim 1 further comprising:

a partition extending across the screen to separate the screen into a left side and a right side.

3. The apparatus of claim 1 further comprising:

an angled portion in the bracket that receives a top portion of the triangular tensioning element.

4. An apparatus comprising:

a screen having apertures sized to separate a first sized material from a second sized material;

a box positioned beneath the screen in a bracket extending along the screen;

a protrusion extending from the box toward the screen; and a triangular tensioning element secured along a length of the screen wherein the triangular tensioning element moves in a direction substantially perpendicular to the length of the screen in response to contact with the protrusion to seal the screen against the bracket and tension the screen, wherein the screen seals against the protrusion of the box.

5. An apparatus comprising:

a screen having apertures sized to separate a first sized material from a second sized material;

a box positioned beneath the screen in a bracket extending along the screen;

a protrusion extending from the box toward the screen;

a triangular tensioning element secured along a length of the screen wherein the triangular tensioning element moves in a direction substantially perpendicular to the length of the screen in response to contact with the protrusion to seal the screen against the bracket and tension the screen; and an angled portion in the bracket that receives a top portion of the triangular tensioning element, wherein the triangular tensioning element seals to the bracket at the angled portion.

6. An apparatus comprising:

a screen having apertures sized to separate a first sized material from a second sized material;

a box positioned beneath the screen in a bracket extending along the screen;

a protrusion extending from the box toward the screen;

a triangular tensioning element secured along a length of the screen wherein the triangular tensioning element moves in a direction substantially perpendicular to the length of the screen in response to contact with the protrusion to seal the screen against the bracket and tension the screen; and a bladder inflating to move the box and the screen against the bracket.

7. A system comprising:

a screen having sides wherein the screen extends between the sides;

a bracket on each side for positioning the screen therein;

a tensioning element secured along a length of each side of the screen wherein the tensioning element rotates in response to receiving a compressive force to secure the screen against the bracket; and a retaining wall on the bracket to receive the tensioning element upon rotation.

8. The system of claim 7 further comprising:

a box beneath the screen wherein movement of the box compresses the tensioning element.

9. The system of claim 7 further comprising:

a protrusion beneath the screen wherein the protrusion compresses against the tensioning element to rotate the tensioning element toward the screen.

10. The system of claim 7 further comprising:

a cavity in the bracket that receives the tensioning element.

11. The system of claim 7 further comprising:

a centerpiece that divides the screen into a left side and a right side.

12. The system of claim 7 further comprising:

a wall formed along the bracket wherein an inclined section extends from the wall to guide rotation of the tensioning element.

13. The system of claim 7 wherein a curvature of the bracket corresponds to a curvature of the tensioning element to fit the tensioning element into the bracket.

14. The system of claim 7 further comprising:

a seal formed where a protrusion beneath the screen contacts the tensioning element.

15. The system of claim 7 further comprising:

a seal formed where the tensioning element contacts the bracket.

16. A method comprising:

inserting a box into a separator with a bracket wherein the box has a protrusion extending from the box;

positioning a screen on the bracket holding a tensioning element;

rotating the tensioning element toward the screen in response to compression with the box; and securing the screen against a rail by the tensioning element.

17. The method of claim 16 further comprising:

receiving a gas to inflate the air bag.

18. The method of claim 16 further comprising:

expanding an air bag positioned beneath the screen to move the box toward the screen to compress the box against the tensioning element.

19. The method of claim 16 further comprising:

filtering solids from liquid from a slurry flowing through the screen.

* * * * *